US006402612B2

(12) United States Patent
Akhtar et al.

(10) Patent No.: US 6,402,612 B2
(45) **Date of Patent: *Jun. 11, 2002**

(54) COLUMN FAN UNIT

(75) Inventors: Salman Akhtar; Ming Hui Han, both of Mississauga (CA)

(73) Assignee: Air Handling Engineering Ltd., Buffalo, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/761,984

(22) Filed: Jan. 17, 2001

Related U.S. Application Data

(63) Continuation-in-part of application No. 09/491,904, filed on Jan. 27, 2000, now Pat. No. 6,267,665.

(51) Int. Cl.[7] ..... F24F 13/24

(52) U.S. Cl. ..... 454/186; 181/224; 181/225; 454/228; 454/906

(58) Field of Search ..... 454/186, 228, 454/234, 262, 269, 338, 906; 55/467, 467.1; 181/224, 225; 165/50, 54, 59

(56) References Cited

U.S. PATENT DOCUMENTS

| | | | |
|---|---|---|---|
| 4,295,416 | A | 10/1981 | Gorchev et al. |
| 4,418,788 | A | 12/1983 | Gorchev et al. |
| 4,646,966 | A | 3/1987 | Nussbaum |
| 4,773,309 | A | 9/1988 | Walters |
| 4,874,127 | A | 10/1989 | Collier |
| 4,986,170 | A | 1/1991 | Ramakrishnan et al. |
| 5,314,376 | A | 5/1994 | Kuramarohit |
| 5,473,124 | A | 12/1995 | Yazici et al. |

FOREIGN PATENT DOCUMENTS

| | | | |
|---|---|---|---|
| DE | 2627370 | A1 | 12/1977 |
| DE | 4037287 | A1 | 7/1991 |
| JP | 40110560 | | 4/1992 |

*Primary Examiner*—Harold Joyce
(74) *Attorney, Agent, or Firm*—Gifford, Krass, Groh, Sprinkle, Anderson & Citkowski, P.C.

(57) ABSTRACT

An air handling system for use in a building is used in combination with an elevated floor assembly for mounting on a principal floor of the building, this assembly including a working area floor which lies above the principal floor so as to provide an air plenum between the two floors. An outlet attenuator is mounted on the principal floor and extends upwardly through the working area floor, this attenuator including an exterior outlet housing having an air inlet at the top and a lowermost air outlet in at least one vertical side thereof. The air outlet is connected to the air plenum and is connected to the air inlet by a lower airflow passageway defined by interior walls. This attenuator includes sound absorbing material contained in the housing. An axial or centrifugal fan unit is mounted above the outlet attenuator and provides a downward flow of air to the outlet attenuator. There is also an inlet attenuator section mounted above the fan unit and extending upwardly to a ceiling of the building. The inlet attenuator has an exterior housing with an upper air inlet and a circular bottom air outlet. The inlet attenuator in one preferred embodiment includes an elongate airflow member mounted centrally in the airflow passageway that extends between the air inlet and air outlet. In another version, the inlet attenuator has its airflow passageway divided into two passageways by a conical divider wall.

41 Claims, 8 Drawing Sheets

COLUMN FAN UNIT

This is a continuation-in-part application of U.S. patent application Ser. No. 09/491,904 filed Jan. 27, 2000 now U.S. Pat. No. 6,267,665.

BACKGROUND OF THE INVENTION

This invention relates to air handling systems for use in a building in order to supply air to the interior of a building and, in particular, to such a system employing an axial fan unit.

A number of different air handling systems are known for providing conditioned air to a building's interior. These systems can vary depending upon the size of and requirements of the building. They also differ on the basis of the perceived requirements for heating and cooling in the building. Particularly in systems designed for larger buildings, a concern of the building owner and of the users of the building is that the air handling system be not only efficient for the delivery of conditioned air to each floor of the building but also relatively quiet in its operation.

Relatively sophisticated air handling systems for multi-storey buildings are already known in the heating and air conditioning industry. For example, it is already known to provide a relatively large axial fan on a lower floor of a multi-storey building in order to deliver the required conditioned air through a system of air ducts to the various floors of the building. In order to reduce the sound levels that are produced by the operation of the fan, the fan inlet can be mounted adjacent an inlet attenuator which directs incoming air into the inlet side of the fan. There can also be an outlet attenuator mounted adjacent the outlet side of the fan and connected to one or more air delivery ducts. Both of these attenuators can have exterior walls and specially designed interior walls with sound attenuating material arranged between the interior and exterior walls. One perceived difficulty with these known system is that they generally require a reasonably large room set aside on the lower floor for the air handling system, including the attenuators and, with such systems, difficulties can be encountered in controlling the conditioned air delivered to each floor of the multi-storey building and in modifying the air delivery system when changes, are made to the layout of one or more of the floors of the building.

In U.S. Pat. No. 4,418,788 issued Dec. 6, 1983 to Mitco Corporation there is disclosed a composite branch take-off and silencer for an air distribution system. This take-off unit includes two series-coupled sections including a static pressure regain section and a channel section adapted for coupling an input duct to an output duct and branch ducts. With this unit, the input section is located adjacent the axial fan which is generally located at the bottom end while the channel section which is coupled to a main duct for the delivery of air is located in the upper half of the unit. Sound absorbing material is used at several locations in the unit to reduce the amount of sound passing through the unit and into the air ducts.

More recent U.S. Pat. No. 4,874,127 issued Oct. 17, 1989 to W. R. Collier describes a multi-level access flooring system with a working area floor and at least one intermediate floor. A horizontal plenum is formed between an intermediate floor and the building floor. An HVAC unit is mounted on an elevated top floor and this unit has an axial fan and an air outlet located at the bottom thereof. Just above the outlet are arranged evaporator coils. Air from the room enters the HVAC unit through a top grill. As there is no provision for reducing the sound levels emanating from the axial fan, it appears that the climate control system described in this patent specification would be relatively noisy. There is also no provision in this system for mixing fresh air with return air before it is passed through the HVAC unit and delivered to the air distribution plenum and the air outlets.

U.S. Pat. No. 4,646,966 issued Mar. 3, 1987 to Argon Corp. teaches a personalized air conditioning system which employs an air plenum formed by an elevated floor of the building. Air rises from the floor space into an air distribution system which includes an upstanding passageway or column that has upright sidewalls. A small fan is mounted in the column as is an air valve which apparently regulates the air passing upwardly in the column. A plurality of air outlets are provided near the top of the column and are adjustable.

It is an object of the present invention to provide an efficient air handling system that can be provided on each floor of a building, particularly a high-rise building, in order to supply air to the interior.

It is a further object of the present invention to provide a novel air handling system for use in a building having an elevated floor assembly mounted on a principal floor of the building, this assembly including a working area floor which lies above the principal floor so as to provide an air plenum.

It is another object of the present invention to provide an air handling system for use in a building, the system including an air outlet section with a lowermost air outlet, an axial fan unit and an air inlet section that is mounted above the axial fan unit and that has an air mixing chamber arranged to receive airflows entering through air inlet openings.

SUMMARY OF THE INVENTION

According to one aspect of the invention, an air handling system for use in a building in order to supply air to the interior thereof comprises, in combination, an elevated floor assembly for mounting on a principal floor of the building, an outlet attenuator for mounting on this principal floor, an axial fan unit mounted above the outlet attenuator, and an inlet attenuator section mounted above the axial fan unit. The floor assembly includes a working area floor which in use lies above and is spaced apart from the principal floor so as to provide an air plenum between the principal floor and the working area floor. The outlet attenuator is adapted to extend upwardly through the working area floor. This attenuator includes an exterior outlet housing having a lower air inlet in the top thereof and a lowermost air outlet in at least one vertical side thereof. The lowermost air outlet is connected to the air plenum during use of the system and is connected to the lower air inlet by a lower air flow passageway defined by interior walls of the attenuator. The outlet attenuator further includes sound absorbing material contained in the housing that extends to and is covered by the interior walls. The axial fan unit is capable of providing downward air flow into the lower air inlet of the outlet attenuator. The inlet attenuator extends upwardly to a ceiling of the building during use of the system. This attenuator includes an exterior inlet housing having an upper air inlet in an upper region thereof and a bottom air outlet in a bottom side thereof. The bottom air outlet is connected to a top inlet of the axial fan unit. The inlet attenuator section further includes sound absorbing material contained in the inlet housing and interior walls forming an upper airflow passageway extending from the upper air inlet to the bottom air outlet.

Preferably, the inlet attenuator section includes air filter panels mounted in the inlet housing and arranged so that all airflow through the upper airflow passageway during use of this system is required to flow through the air filter panels.

According to another aspect of the invention, an air handling system for use in a multi-storey building in order to supply air to a level of the building comprises an outlet attenuator adapted for mounting on a floor of the building, a fan unit mounted above the outlet attenuator and a fan inlet section mounted above the fan unit. The outlet attenuator includes an exterior outlet housing having an air inlet in the top thereof and a lowermost air outlet in at least one vertical side thereof. The air inlet and the air outlet are connected by a lower airflow passageway defined by interior walls. The outlet attenuator further includes sound absorbing material which is contained in the housing and extends to and is covered by the interior walls. The fan unit is capable of providing downward air flow into the air inlet of the outlet attenuator. The fan inlet section extends upwardly from the fan unit and includes an exterior inlet housing with a bottom air outlet in a bottom end thereof and an upper airflow passageway that extends downwardly to the bottom air outlet. The bottom air outlet is positioned directly above the air flow inlet of the fan unit.

Preferably the fan inlet section is a sound attenuator and contains sound absorbing material positioned behind perforated interior walls. In a particularly preferred embodiment, the fan inlet section includes a central elongate airflow member mounted centrally in the upper airflow passageway and having a vertical longitudinal axis. This airflow member also contains sound absorbing material.

According to another aspect of the invention, an air handling system for use in building in order to supply an air mixture to the building comprises, in combination, an air outlet and sound attenuator section adapted for mounting on a floor of the building, a fan unit mountable above the air outlet section, and an air inlet and sound attenuator section mounted above the fan unit. The outlet section includes an outlet housing containing sound absorbing material and a lower airflow passageway extending vertically through the outlet housing to a lowermost air outlet located in at least one vertical side thereof. The fan unit is capable of providing downward airflow into the lower airflow passageway. The air inlet and sound attenuator section includes an inlet housing with a round bottom air outlet in the bottom end thereof and an upper airflow passageway that tapers inwardly in a downwards direction and extends downwardly to the bottom air outlet. The upper airflow passageway is surrounded on vertically extending sides thereof with sound absorbing material. The upper airflow passageway is connected so as to deliver a mixed airflow to an inlet of the fan unit. The inlet housing has first and second air inlet openings formed in an upper section thereof. The first air inlet opening is adapted to receive fresh incoming air and at least the second air inlet opening is adapted to receive return air from the building. During use of the system, the fresh incoming air and the return air are mixed in the air inlet and sound attenuator section.

According to still another aspect of the invention, an air handling system for use in a building in order to supply treated air to the building comprises an air outlet and sound attenuator section adapted for mounting on a floor of the building and including an outlet housing containing sound absorbing material and having a lower airflow passageway extending vertically through the outlet housing to a lowermost air outlet located in at least one vertical side thereof; a fan unit mountable above the air outlet section and capable of providing downward airflow into the lower airflow passageway, and an air inlet and sound attenuator section mounted above the fan unit and including an inlet housing. This housing has a round bottom air outlet in a bottom end thereof and an upper airflow passageway that tapers inwardly in a downwards direction and that extends downwardly to the bottom air outlet. The upper airflow passage is surrounded on vertically extending sides thereof with sound absorbing material. An upper section of the inlet housing has an air inlet opening provided in two or more of the vertically extending sides. The upper airflow passageway is divided into at least two smaller passageways, that extend from the air inlet opening to the bottom air outlet, by means of a substantially conical divider wall which is substantially coaxial with the upper airflow passageway. There is also at least one heat exchanging coil unit mounted in the air inlet and sound attenuator section for heating or cooling at least a portion of the airflow entering the system through the air inlet opening.

Further features and advantages will become apparent from the following detailed description taken in conjunction with the accompanying drawings.

DETAILED DESCRIPTION OF PREFERRED EMBODIMENT

Figure 1:
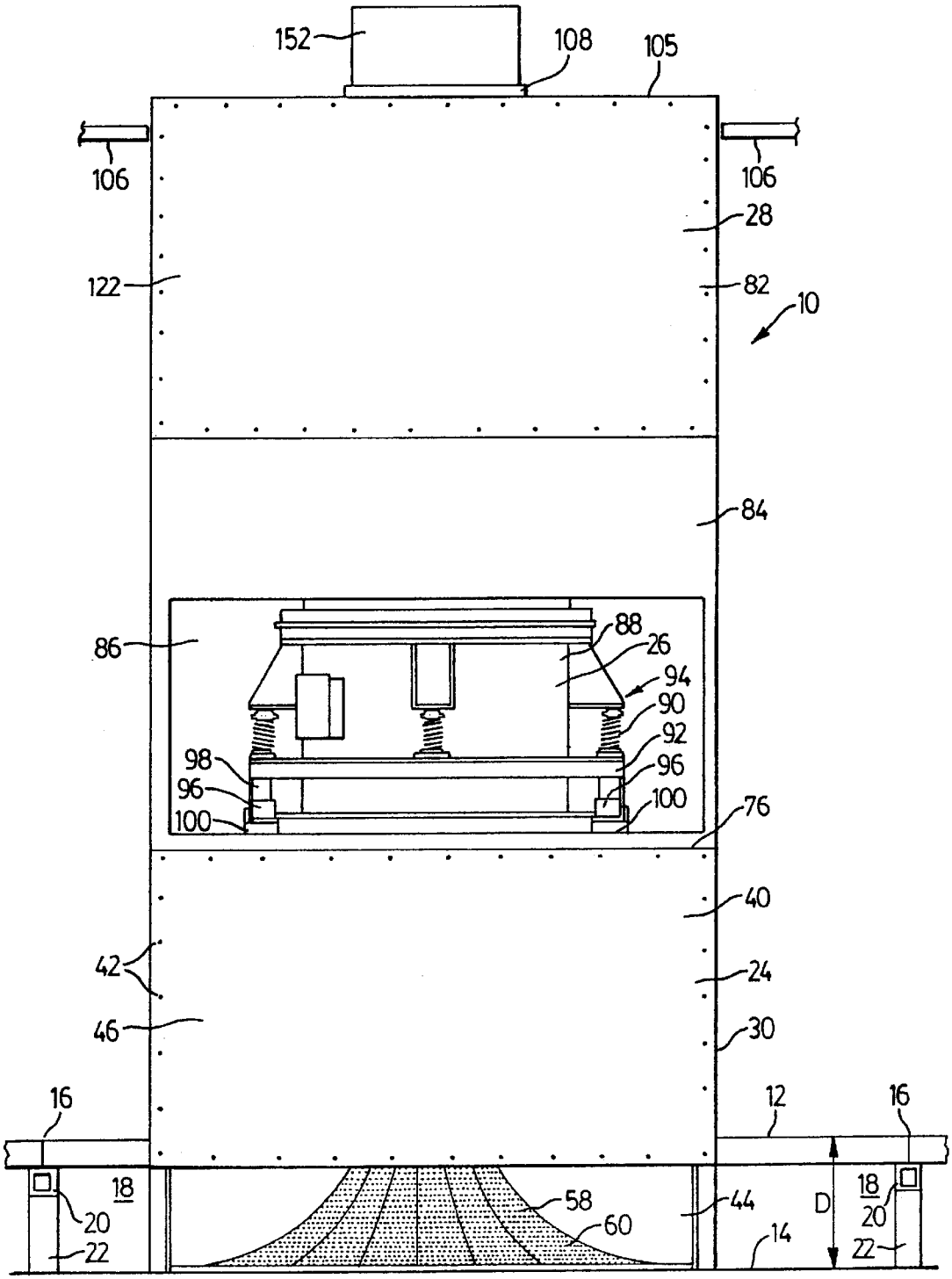
FIG. 1 is a side elevation of an air handling system constructed in accordance with the invention.

One version of an air handling system of the present invention is illustrated generally in FIG. 1. This system includes a vertically extending or column like air handling unit 10, the details of which can be seen to a greater extent in FIG. 2. The air handling system is for use in a building, particularly a multi-storey building such as an office tower, the system providing or supplying air to the interior of the building. In particular, the preferred, illustrated air handling system is intended to supply conditioned air to one floor level of the multiple storey building. One or more of the air handling units 10 can be installed on each floor level of the building, as required. Because these units are intended to supply air to a single floor level, they can be made smaller and more compact than would be the case for an air handling unit designed to supply conditioned air to a complete multiple storey building.

The air handling unit 10 is preferably used in combination with an elevated floor assembly 12 illustrated in part in FIG. 1. The floor assembly is mounted on a principal floor 14 of the building which in many cases will be a concrete floor capable of supporting substantial weight, including the weight of the air handling unit 10. The floor assembly 12 includes a working area floor 16 which in use lies above and is spaced apart a distance D from the principal floor so as to provide an air plenum 18 between the principal floor 14 and the working area floor 16. It will be understood that both the principal floor 14 and the working area floor 16 would normally extend over most of the floor area of the building at the floor level where the unit 10 is installed. The floor assembly 12 can be constructed in a variety of known ways and therefore a detailed description of the floor assembly is deemed unnecessary herein. For example, it can be constructed in a manner similar to that illustrated and described in U.S. Pat. No. 4,874,127 issued Oct. 17, 1989 except that there is only one elevated floor at 16. It can, for example, be made with the use of horizontally extending floor panels which cover the working area on which workers move in performing their task and on which equipment normally used in the room is supported. The panels can be supported on horizontally extending beams or frame members 20 which are in turn supported by a plurality of pedestals 22 arranged in a suitable grid.

One of the advantages of the air handling system of the invention is that it is relatively easy to provide a conditioned air outlet at almost any location on the floor level since the air plenum 18 extends over substantially all of the floor area. It is simply necessary to form or provide a suitable air outlet at the desired location in one of the panels forming the working area floor 16. It is not necessary to install a new, elongate air duct to move the conditioned air from the outlet of the air handling unit 10 to the desired outlet location.

The air handling unit 10 includes an outlet attenuator 24 which can be mounted on the principal floor 14 and is adapted to extend upwardly through the working area floor 16 as shown in FIG. 1. In the preferred illustrated embodiment, the outlet attenuator 24 is constructed as a separate section, the height of which is indicated by $H_1$ in FIG. 2. The air handling system 10 preferably comprises two major sections, one of which is the outlet attenuator and the other of which includes a fan unit indicated generally at 26 and an inlet attenuator section 28. Although the illustrated, preferred fan unit 26 is an axial fan unit having a vertical rotation axis, other types of fan units could also be used with suitable modifications to the inlet and outlet attenuator sections. For example, a centrifugal fan unit could be used. The overall height of the second major section is indicated by $H_2$ in FIG. 2. By splitting the rather high air handling unit 10 into these two major sections, the unit 10 is easier to handle and to transport to the floor of the building where it is to be installed. The second major section that includes the fan unit and the inlet attenuator is made so as to be mountable on and supported by the outlet attenuator section, which can also be described as an air outlet and sound attenuator section 24.

Figure 2:
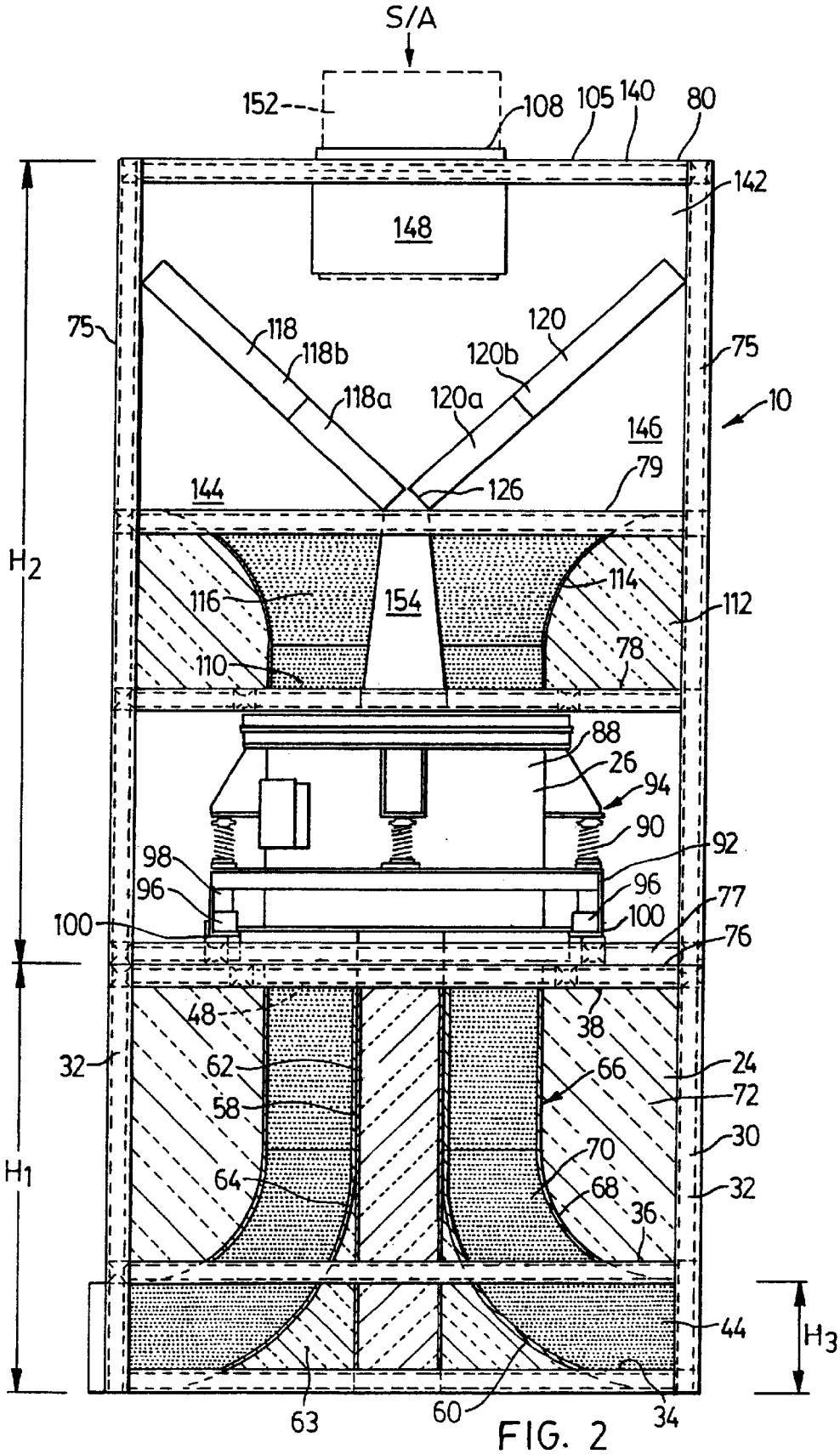
FIG. 2 is a side elevation of the air handling unit including an outlet attenuator, an axial fan unit and an inlet attenuator with the airflow passageways in the two attenuators being shown in cross-section and panels removed for illustration purposes.
Figure 4:
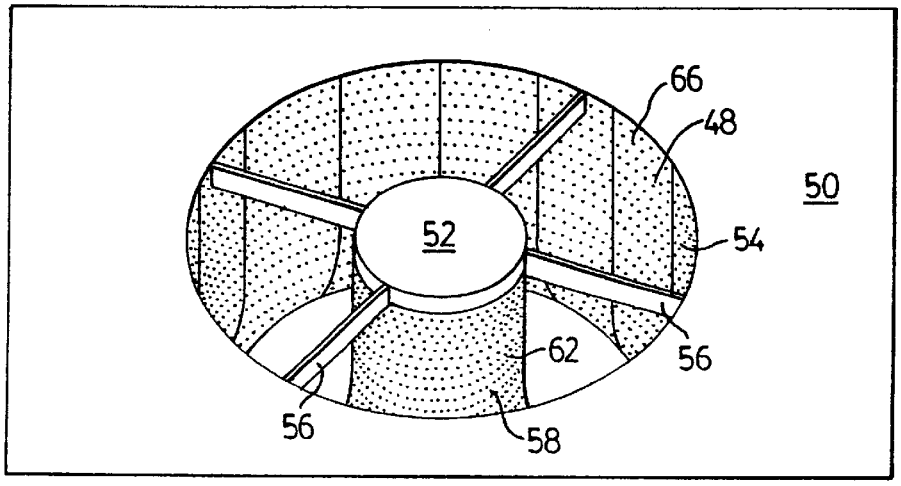
FIG. 4 is a perspective view taken from above and to one side showing the top of the outlet attenuator with the attenuator separated from the axial fan unit (not shown) and the housing of FIG. 3.

The air outlet attenuator 24 includes an exterior outlet housing 30 that is constructed with the use of a box like framework that includes four upright frame members 32, two of which can be seen in FIG. 2. Each pair of frame members 32 located on each side of the unit is rigidly connected to one another by three horizontal frame members 34, 36 and 38. Covering the outside of the housing 30 are four metal rectangular panels 40, each of which is attached to the adjacent frame members 32, 36 and 38 by means of suitable fasteners such as screws or bolts indicated at 42. The gap between the bottom edge of each panel 40 and the bottom of the outlet housing can either be open or closed as desired. The unit shown in FIGS. 1 and 2 has a lowermost air outlet 44 located in the side 46 of the outlet attenuator but it will be appreciated that two, three or all four sides of the outlet attenuator can be provided with a rectangular air outlet such as the outlet 44 shown in FIG. 1. Which sides will have a lowermost air outlet will depend upon the particular location of the air handling unit in the building and the airflow requirements of the floor level where the unit is installed. If one or more of the sides of the outlet attenuator is to be completely enclosed so that there is no air outlet, each of these sides can be covered at the bottom end with a rectangular metal panel similar to the panel 40 but of smaller height. The outlet attenuator 24 has an air inlet 48 located in a top 50 thereof. The preferred air inlet 48 (herein referred to as the "lower air inlet") is illustrated in FIG. 4 and it will be seen that it is an annular air inlet in the center of which is a circular metal cap 52. This cap is connected to perforated interior wall 54 by means of four radially extending struts 56. The cap 52 forms the upper end of an inner airflow defining member identified generally by 58, this member having a substantially funnel-shaped bottom section 60 that can be seen in FIG. 1 and an elongate cylindrical upper section 62, the height of which can be seen in FIG. 2. Interior walls that form these two sections are formed with perforated sheet metal in a manner known per se in the construction of air flow attenuators and silencers. As shown in FIG. 2, preferably a cylindrical metal tube forms the upper section 62 and extends right down to the bottom end of the outlet attenuator. This metal tube helps support the conical or funnel shaped bottom section 60 with the upper ends 64 of the bent, perforated metal plates that comprise the outer surface of the bottom section being permanently attached such as by welding to the cylindrical metal tube the bottom section 60 of the air flow defining member has an outwardly and downwardly extending outer surface capable of reflecting downward airflow outwardly to the air outlet 44.

The air outlet attenuator 24 includes a second, perforated interior wall located at 66 and again the upper portion of this interior wall is cylindrical while the lower portion indicated at 68 is funnel-shaped. The interior walls of the attenuator define a lower airflow passageway 70 which extends from the lower air inlet 48 to the lowermost air outlet or air outlets 44. The air outlet or outlets 44 are connected to the air plenum 18 when the unit has been installed in the manner shown in FIG. 1. Also, in a manner known per se in the attenuator art, sound absorbing material 72 is contained in the outlet housing 30 and extends to and is covered by the interior walls. In particular, the space between the interior wall 66 and each exterior panel 40 can be filled with this sound absorbing material and the perforated metal tube that forms the upper section 62 can be filled with this material as well. Also, the space 63 between the bottom section of the aforementioned metal tube and the curved metal panels forming the bottom section 60 can be filled with this material. Accordingly, it will be appreciated that any sound that emanates downwardly from the fan unit 26 will be reduced to a substantial extent by this efficient outlet attenuator. The inner airflow defining member 58 can be considered a central airflow guide member with a vertical, cylindrical upper portion 62 that is coaxial with the axis of rotation of the fan unit 26. It will be appreciated as well that the cap 52 at the upper end of this member is aligned with the hub portion of the axial fan, the rotating fan blades of which are not shown in the drawings.

The outlet attenuator 24 is substantially rectangular in plan view and preferably is substantially square in plan view. Because these air handling units 10 are designed to be installed and operated on each floor level of a high-rise building, they can be made reasonably compact and in fact, if desired, they can be constructed so as to be similar in size and outer appearance to a supporting structural column of the building. Preferably each of the two horizontal dimensions of the air handling unit 10 do not exceed five feet and the outlet attenuator 24, the axial fan unit 26 and the inlet attenuator section 28 have a combined height of at last about nine feet and not more than about twelve feet with the actual selected height depending upon the actual height of the floor level in which the unit is to be installed. In one particularly preferred embodiment of the air handling unit 10, the horizontal dimensions of the unit were only slightly more than four feet in each direction, measuring fifty-three inches each way. The total height ($H_1$ and $H_2$) of this preferred unit was 111" or 9 feet 3". The height $H_3$ of the air outlet 44 as measured from the bottom end of the unit was ten inches.

It will be understood that in order to provide for a smooth air flow from the air handling unit into the air plenum 18, the interior walls of the outlet attenuator are smoothly curved at least in the lower section of the attenuator. In the illustrated preferred embodiment, the airflow passageway 70 curves through approximately 90° from the air inlet 48 to the one or more lowermost air outlets 44.

Turning now to the upper section of the preferred air handling unit 10, this section also includes a housing that is generally box like and has four vertical frame members 75 that extend from the top of the unit to the bottom end of the section at 76. Extending between each adjacent pair of these frame members are four horizontal connecting frame members 77 to 80. The aforementioned fan unit 26 is located in the rectangular box between frame members 77 and 78 while the inlet attenuator section is located in the space extending from the frame members 78 to the top frame members 80. The vertical sides of the housing are preferably covered with generally rectangular metal panels including the panels 82 and 84 shown in FIG. 1. These panels can be attached by suitable threaded fasteners such as bolts or screws or, in the case of any panels that need not be removed, by means of rivets. For sake of illustration, in FIG. 1, a lower, rectangular metal panel that would cover the rectangular opening at 86 has been removed. The illustrated fan unit 26 is located behind this panel of which there can be as many as four, one on each side. It will be understood, however, that in actual use of the air handling unit, all four sides of the fan unit 26 are normally covered by these metal panels so that the fan unit cannot be seen. The removable metal panel covering the opening 86 is attached by threaded fasteners such as screws.

Turning now to the fan unit 26, the fan unit itself can be of standard construction except that it is oriented so as to provide a downward airflow into the air inlet 48 of the outlet attenuator. The rotating fan blades (not shown) are rotatably mounted in a cylindrical fan housing 88 which is open at its upper and lower ends. In order to dampen vibrations from the operation of the fan, in a known manner the fan housing is mounted on a number of coil springs 90 which extend between a horizontal platform 92 and support brackets 94. The platform 92 is mounted on four rollers 96 mounted at the bottom end of short, vertical legs 98. The rollers can roll along two parallel metal tracks 100 which can be made of elongate angle members. The angle members can be seen clearly in FIG. 3. These angle members are mounted on horizontal connecting frames 102, the ends of which are rigidly connected to two of the frame members 77. It will thus be seen that the fan unit is mounted in such a way that it can be readily removed from between the inlet attenuator and the outlet attenuator for servicing, repairs or replacement. Suitable, known sealing units or gaskets are provided at each end of the fan housing to close the gap between the end of the fan housing and the adjacent attenuator and to prevent the escape of air at the ends of the housing.

The air inlet and sound attenuator section 28 is mounted above the fan unit 26 and extends upwardly to a ceiling of the building during use of this system. It will be understood however that the top end of the unit located at 105 is normally spaced below the actual structural ceiling of the building which may comprise a solid concrete slab (forming the floor of the next building level). Often a suspended ceiling 106 is formed or provided below the structural ceiling and it is this ceiling that is seen by users of the building. This ceiling may comprise rows of standard ceiling panels supported by suitable support members and hangers (not shown). In the normal installation of the present air handling unit, the top of the unit extends through the suspended ceiling 106 in the manner shown in FIG. 1. This enhances the appearance of the air handling unit and again can give rise to the impression that the air handling unit has the appearance of a standard building column.

The preferred air inlet and sound attenuator section 28 includes an exterior inlet housing which can simply be the upper portion of the housing described above that includes frame member 75 and members 77 to 80. The inlet housing has an upper air inlet 108 and a bottom air outlet 110 in a bottom side thereof. The bottom air inlet 110 is connected to a top inlet of the axial fan unit 26. Standard sound absorbing material 112 is contained in the inlet housing, being positioned between perforated interior walls 114 and exterior walls of the housing formed by the aforementioned panels 84. The interior walls 114 form an upper airflow passageway 116 that connects the upper air inlet to the bottom air outlet 110.

Figure 3:
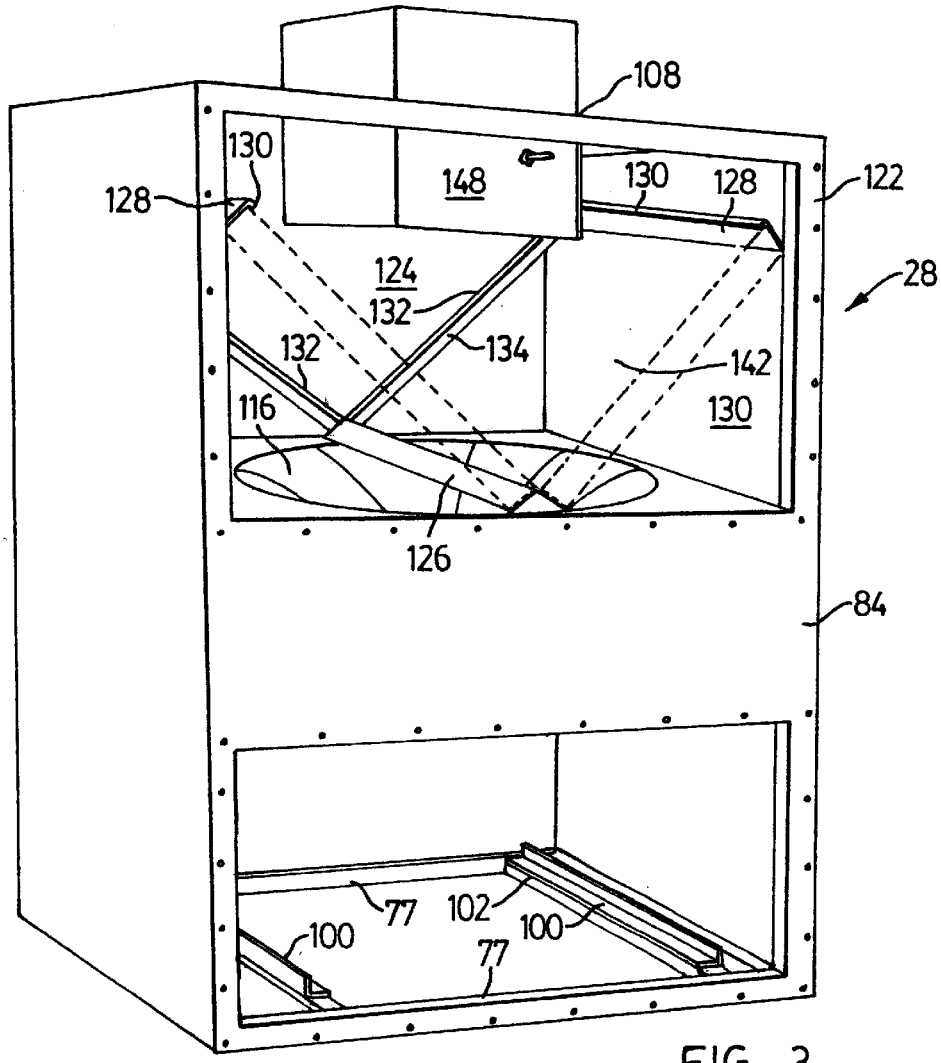
FIG. 3 is a perspective view of the housing that incorporates the inlet attenuator and in which the axial fan unit can be mounted.

The preferred inlet attenuator section includes air filter panels 118 and 120 which can be mounted in rectangular, metal frames. As illustrated in FIG. 2 and in FIG. 3, these panels are arranged so that all air flow through the upper airflow passageway 116 during use of the system is required to flow through the air filter panels. Each generally flat air filter panel can be of standard construction and therefore a detailed description thereof herein is deemed unnecessary. In the preferred illustrated embodiment of FIGS. 2 and 3, the filter panels include the two main panels sections 118, 120 arranged in a V-shape and located directly above the upper airflow passageway 116 which is substantially funnel-shaped. Also, as shown in FIG. 2, the combination of the two panels sections 118, 120 extends substantially the width of the inlet attenuator section. Further, each panel section extends substantially from the front side 122 of the inlet attenuator to the rear side 124 as seen in FIG. 3. In order to support the air filter panels, there is an inverted V-shaped support frame 126 that extends across the top of the upper airflow passageway 116 from the front side 122 to the rear side 124. The lowermost side edges of these filter panels can rest against the sloping sides of the frame 126. There are also upper, elongate support frames 128 mounted on interior walls 130 of the inlet attenuator section. Each of the two frames 128 extends at an acute angel to the interior wall and preferably is formed with an upper edge flange 130 which helps to hold the air filter panel in place. In addition, there can be arranged along the rear side 124 two further supporting frame members 132 arranged in a V-shape. The frame members 132 extend between the support frame 126 and the two support frames 128. The frames 132 have a bottom flange 134 that extends perpendicularly from the rear side 124 and on this flange the edge of the filter panel can be supported.

It will also be understood that in order for the filter panels to be maintained or replaced, access to the upper portion of the attenuator section 28 is provided by means of one or more removable access panels. Such an access panel can simply be provided by making one of the rectangular metal panels 82 (see FIG. 1) removable (for example, by removing attaching screws).

If desired, each of the main filter panel sections 118, 120 can comprise two smaller filter sections indicated at 118*a*, 118*b*, 120*a* and 120*b*. In FIG. 2 by splitting the main panel sections in this manner, the filter panels can be easier to remove and replace.

Figure 5:
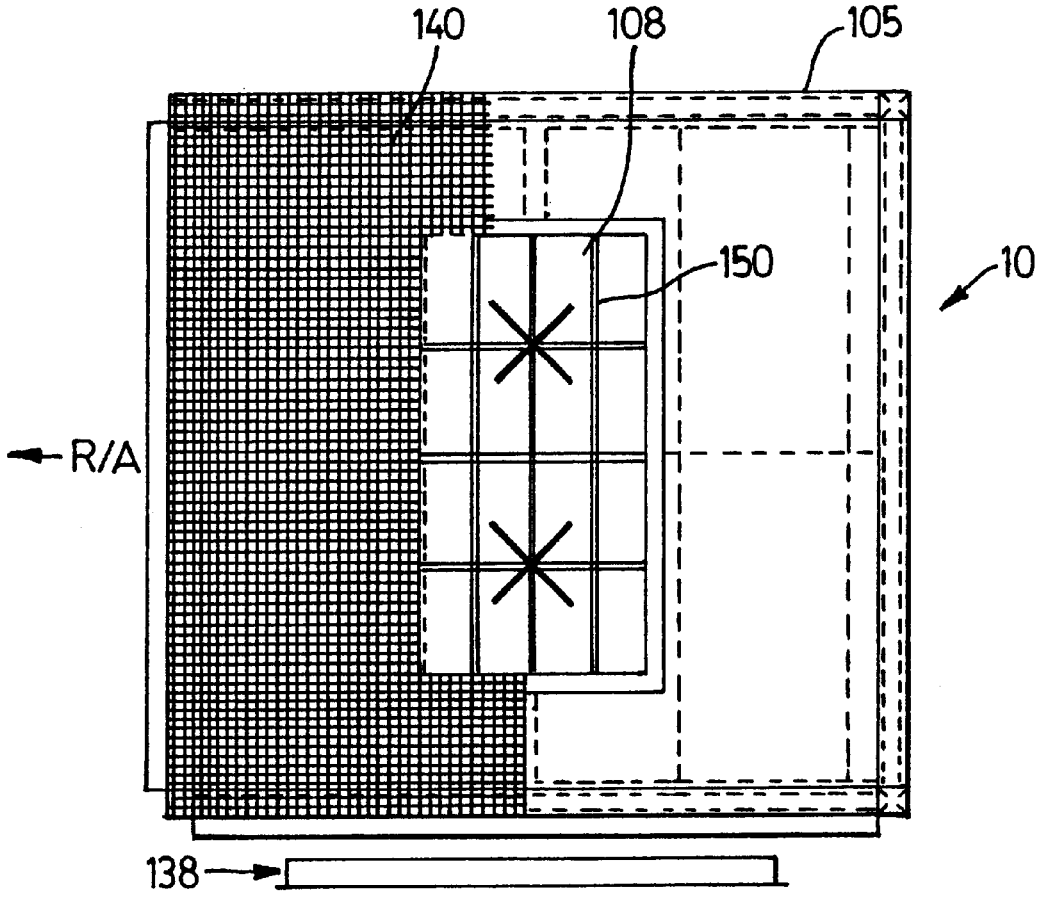
FIG. 5 is a plan view showing the top end of the preferred air handling unit.

Preferably the inlet attenuator section 28 includes not only the air inlet 108 (hereinafter sometimes referred to as the first air inlet), but also a second air inlet opening permitting airflow into the upper end section of the inlet attenuator housing. A preferred form of the second air inlet opening 140 can be seen in FIG. 5. The opening has a square shape and located in the center thereof is the first air inlet opening 108. In the preferred embodiment, return air from the floor level of the building where the unit is installed passes through the second air inlet opening and into an air mixing chamber 142 that is next to and operatively connected to the upper air inlet 116 for delivery of an air mixture thereto. Return air can enter through the opening 140 by passing through return air outlets in the ceiling of the respective floor level and then passing either through return air ducts or preferably through a ceiling plenum located just above the ceiling 106 illustrated in FIG. 1. In the embodiment of FIG. 5, the square opening 140 is covered with a screen which in a particular preferred embodiment is one half inch by one half inch bird screen. The screen helps to prevent any undesired larger objects from passing through the opening to the filter panels or to the fan itself. The bird screen is only shown partially in FIG. 5 but it will be understood that it covers the entire top of the air handling unit 10 except for the area of the first opening 108.

An adequate amount of mixing of the fresh incoming air or secondary air and the return air occurs in the chamber 142 which includes not only the space above the filter panels 118, 120 but also the two spaces directly below these panels identified by references 144 and 146. The central location of the opening 108 also helps the two air flows to mix properly. It will also be noted that a four sided enclosure 148 extends downwardly from the opening 108 into the air mixing chamber. Mounted in the enclosure 148 is a variable air damper which can be of standard construction. A suitable air damper for this purpose is one made by Envirotech. By means of a standard damper control mechanism, the size of the opening 108 can be controlled in order to vary the amount of fresh air or secondary air entering the mixing chamber. The preferred air damper 150 illustrated in FIG. 5 comprises several, straight elongate blades that can be rotated about a horizontal axis in order to open or close the inlet opening 108. These blades can be parallel blades or opposed blades. Extending upwardly from the opening 108 can be a rectangular inlet duct section 152 to which a suitably long air duct (not shown) can be connected for the delivery of fresh air to the opening 108. The duct section 152 can be attached to the top of the unit 10 after the unit 10 has been installed at the required location in the building. It should also be appreciated that instead of the opening 108 in the top of the unit 10, it is also possible to deliver the return air to the mixing chamber 142 by means of a side opening formed in one or more sides of the inlet attenuator section 28 above the filter panels, preferably adjacent the top end of the section 28. A side air inlet may be particularly desirable if the height of the ceiling is relatively low and there is insufficient room to connect a return air duct to a top opening.

Turning now to the preferred form of the upper airflow passageway 116, as illustrated in FIG. 2, a central bullet or airflow defining member 154 extends vertically in the passageway. Although this bullet can be cylindrical and of uniform diameter, the illustrated bullet has a slight taper in the upwards direction. The preferred bullet extends from the air outlet 110 upwardly to the top end of the funnel-shaped passageway 116. The exterior of the bullet is preferably made of perforated sheet metal and the inside of the bullet is filled with sound insulating material. The top end of the bullet is supported in the passageway by means of the aforementioned support frame 126 to which it can be welded. It is also, of course, possible to construct the passageway 116 without the bullet 154. With the bullet 154, the bottom air outlet 110 has an annular shape with a round perimeter. The bottom end of the bullet 154 can be supported by four struts extending radially from the bottom end to the interior wall 114, these struts being similar to those illustrated in FIG. 4.

Preferably, the upper vertical walls (formed by the exterior panels 82) of the inlet attenuator section 28 are also insulated by sound absorbing material that extends right up to the top of the unit. Typically there are two inches of fiberglass insulation in these walls covered by perforated sheet metal on the interior. Similarly, the walls or panels surrounding the fan unit 26 can also be insulated to reduce noise levels.

Figure 6:
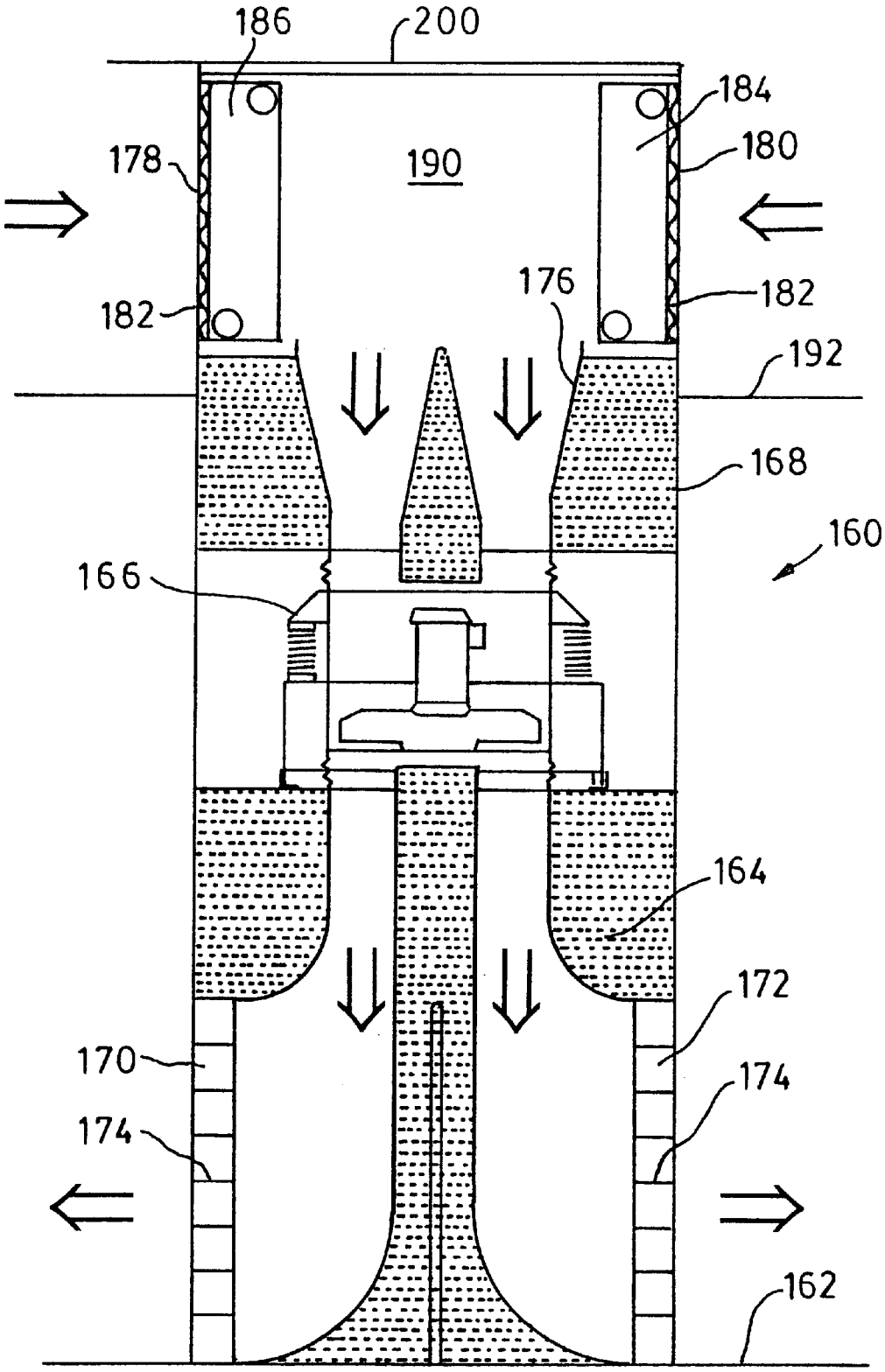
FIG. 6 is a side elevation showing another embodiment of the air handling unit, the airflow passageways of the two attenuators being shown in cross-section.

Another embodiment of a column like air handling unit 160 is shown in FIG. 6 of the drawings. This air handling unit is similar to the air handling unit 10 described above except for the differences noted hereinafter. Again, it will be understood that this air handling unit 160 is intended for use in combination with an elevated floor assembly (not shown). This floor assembly is mounted on the principal floor 162 of the building. The air handling unit 160 includes an outlet attenuator 164 which is mounted on the principal floor 162. Again, a second major section of the air handling system is mounted on top of the outlet attenuator and includes the axial fan unit 166 and an inlet attenuator section 168.

The outlet attenuator 164 is similar to the corresponding attenuator in the first described embodiment. However, the rectangular air outlets, two of which are indicated at 170 and 172 are proportionally larger in this embodiment as compared to the first embodiment, at least with respect to their height. Also, extending over each of the outlets is a diffuser or grill 174 that can be made of metal and that acts to cover the outlet opening. It will be understood that each diffuser has a large number of apertures distributed over its surface for the air to pass through.

The inlet attenuator 168 has a truncated conical passageway at 176 through which incoming air can pass downwardly to the axial fan unit. This attenuator section has two return air inlets located at 178 and 180 on opposite vertical sides of the unit. Extending across each of these air inlets is an air filter 182 which, in one preferred embodiment, has a thickness of one inch. Arranged immediately adjacent each of these air filters is a heat exchanging coil unit 184, 186. Each of these coil units is mounted in the inlet attenuator section so that the incoming air flow passes through the coil unit. It will be appreciated that the coil unit can be set up for either heating the incoming air or cooling this air or a combination of two coil units can be mounted at each inlet to provide either heating or cooling, as desired. The heat exchanger coil unit can be of standard construction per se, for example with copper or aluminum tubes winding back and forth across the unit so that the air will be forced to pass between the tubes which may also be provided with metal fins. It is quite possible to have only one return air inlet opening fitted with a heat exchanging coil unit if only one return air inlet is required. Where there is more than one air inlet, the incoming air flows will mix in the air mixing chamber 190 formed between the two heat exchanging coil units. Fresh or make-up air at room temperature can be provided to this mixing chamber through a third inlet opening located in the top 200 of the inlet attenuator. After this mixing has occurred, the incoming air will then be forced downwardly through the passageway 176, being drawn into this passageway by the fan unit.

Again, it will be understood that the upper portion of the inlet attenuator is preferably located above a false ceiling indicated at 192

In one preferred embodiment of this particular column air handling unit, the heat exchanging coil units are cooling coils with each unit having a horizontal length of forty inches and a vertical height of twenty inches and having a cooling capacity of 450 FPM. Preferably at least one side of the upper section of the inlet attenuator is covered with a removable panel (not shown). This panel can be removed by maintenance or service personnel in order to gain access to the air mixing chamber. This panel is located on one of the vertical sides that is perpendicular to the two sides on which the heat exchanging coil units are provided.

Figure 7:
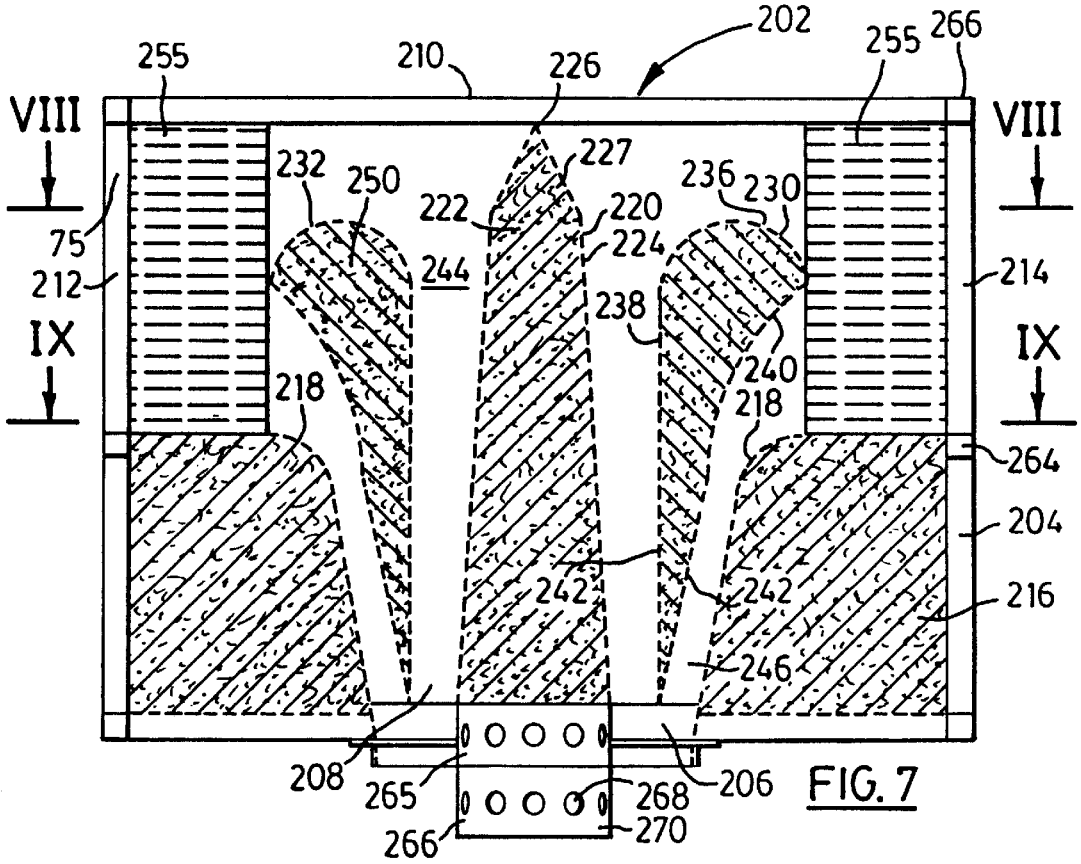
FIG. 7 is a vertical cross-section taken along the central axis of another embodiment of the inlet attenuator.

A preferred form of the air inlet and sound attenuator section of this invention is illustrated in FIG. 7, this particular section being indicated generally at 202. It will be understood that this inlet section is constructed in a manner generally similar to the inlet section of FIG. 6 except as described differently hereinafter. As in the earlier embodiments, this inlet section includes an inlet housing 204 and an annular bottom air outlet 206 with a round periphery. Extending downwardly to this air outlet is an upper airflow passageway 208 which is divided into smaller airflow passageways as explained hereinafter. The passageway 208 tapers inwardly in a downwards direction. As in the embodiment of FIGS. 1 and 2, the air inlet and sound attenuator 202 is provided with an upper air inlet located at 210 which can be similar to that provided by the rectangular air inlet duct section 152 in the first embodiment. The air inlet section 202 of FIGS. 7 and 8 also has one or more and preferably at least two side air inlets indicated at 212 and 214. There can be as many as four side air inlets, one on each of the vertical sides of the air inlet section 202. At least one of these air inlets 210, 212, 214 is adapted to receive fresh incoming air which can be ducted to the unit through the ceiling area and at least one of the air inlet openings at 210, 212, and 214 is adapted to receive return air from the building. During use of this particular air handling system, the fresh incoming air and the return air are mixed in the air inlet and sound attenuator section 202 and therefore a mixed airflow is delivered by the upper airflow passage 208 to the inlet of the fan unit.

The air inlet section 202 contains standard sound absorbing material which is positioned behind perforated interior walls 218 made of sheet metal. These interior walls form vertically extending sides of the upper airflow passageway 208. Thus this passageway is surrounded with sound absorbing material.

The inlet section 202 includes a central, elongate airflow member 220 which is mounted centrally in the upper airflow passageway 208 and which has a vertical longitudinal axis. This airflow member 220 is preferably filled with sound absorbing material 222. The airflow member 220 has an outer peripheral wall 224 which is made of perforated sheet metal and that diverges outwardly from an upper end at 226 to a bottom end thereof. Unlike the central airflow members of the above described embodiments, the airflow member 220 preferably extends up to a point near or at the top of the air inlet section 202. An upper end section 227 of the airflow member preferably is sloped at a greater acute angle to the vertical central axis of the member. This feature together with other features included in the air inlet section 202 provide the unit with improved air attenuating qualities, reducing the sound from the fan that comes out of the air inlet section to a low level.

The preferred air inlet section 202 further includes two or more intermediate airflow members 230 to 233, two of which can be seen in FIG. 7. These airflow members are mounted in the upper airflow passageway 208 and they are spaced from the central elongate airflow member 220 as well as from the internal walls 218. As illustrated in FIG. 7, each of these airflow members is tapered inwardly in a downwards direction from an upper end section thereof, tapering to a point at the air outlet 206. The number of airflow members 230 to 233 will depend, at least in part on the number of the air inlets 212, 214. In the situation where there are two air inlets located on opposite sides of the unit, there are at least two of the intermediate airflow members 230, 232 but optionally there can also be two interconnecting, similar airflow members 231, 233. In the case of four side air inlets, one on each of the vertical sides of the air handling unit, there are normally four of the airflow members 230 to 233. The illustrated preferred airflow members are constructed on their periphery with an arcuate top sheet metal panel 236, an inner panel section 238 that extends down to the bottom point, an outer arcuate panel 240, and a transition wall section 242 that extends downwardly from the panel section 240. It will be understood that the inner panel section 238 is a transition panel providing a transition in cross-section of the inner airflow passageway 244 from rectangular (about its outer periphery) at the top to circular at the bottom. Similarly the transition wall panel section 242 changes the outer airflow passageway 246 from rectangular at its upper end to circular at its bottom.

It will be understood that the airflow members 230 to 233 can be rigidly connected to one another, for example by welding, and can be connected to the interior walls 218 by suitable, rigid connecting straps (not shown) that do not interfere with the airflow significantly. Also each of the airflow members 230 to 233 is substantially filled with sound absorbing material indicated at 250. This material can, for example comprise fibreglass insulation. It will be seen that the effect of the airflow members 230 to 233 is to divide up the return airflow entering through the side air inlets and this helps to ensure that the return air entering into the unit flows smoothly and without undue turbulence into the fan inlet. Furthermore the presence of these airflow members helps to block direct transmission of sound from the fan unit through the air inlet section 202 and out through the air inlets 212, 214.

Figure 8:
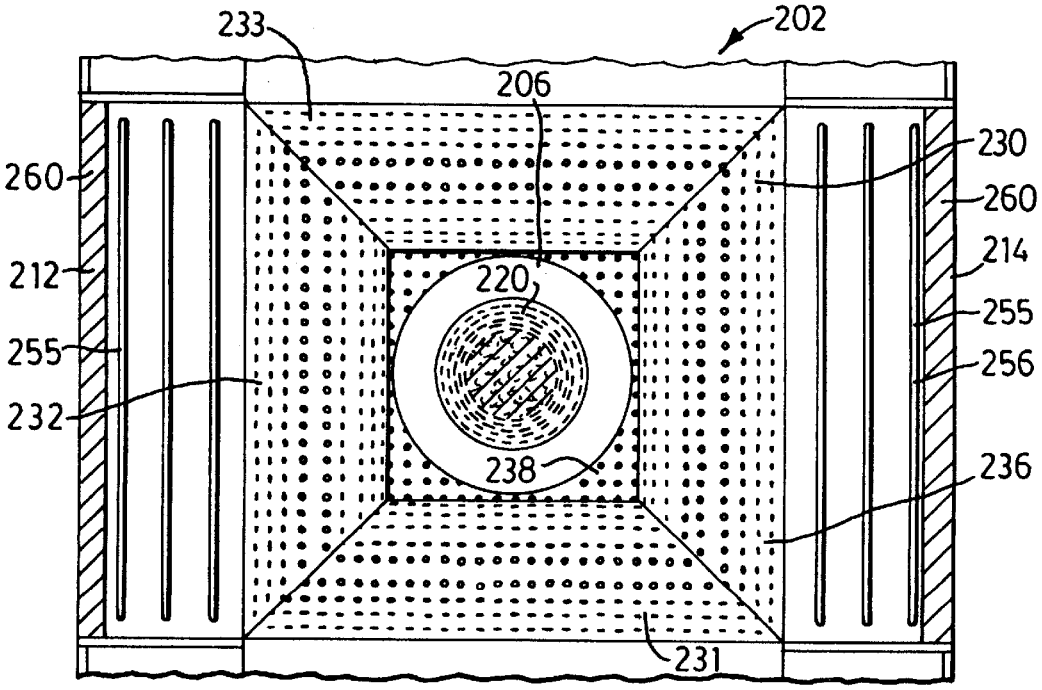
FIG. 8 is a horizontal cross-section of the inlet attenuator taken along the line VIII—VIII in FIG. 7.
Figure 9:
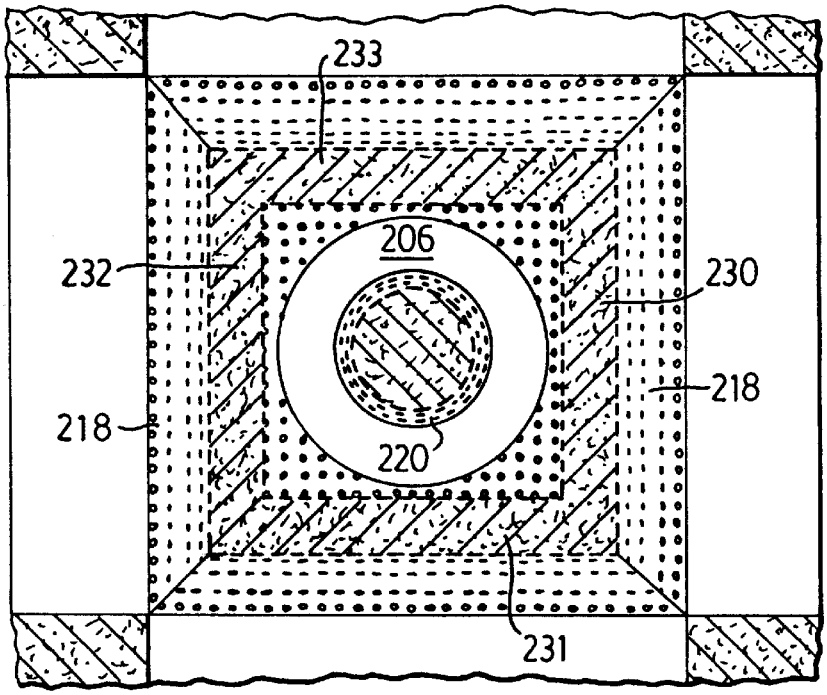
FIG. 9 is another horizontal cross-section of the inlet attenuator taken along the line IX—IX in FIG. 7.

In a preferred embodiment of this unit, there is at least one heat exchanging coil unit arranged in at least one of the air inlets 212, 214 so that incoming air passes through the coil unit. In FIGS. 7 and 8 each of the air inlets 212, 214 is provided with a heat exchanging coil unit 255. These heat exchanging coil units can be of standard construction. For example they may comprise one or more lengths of pipe 256 which wind back and forth across the inlet and through which a suitable heat exchanging fluid, such as water, passes. A number of metal fins can be mounted on these pipes and arranged in a closely spaced manner and parallel to one another as indicated in FIG. 7. If desired, there can be one set of heat exchanging coils for heating purposes and a separate, adjacent set of heat exchanging coils for cooling purposes. Alternatively, only one set for cooling or one set for heating may be provided. Preferably there are mounted on the outside of these heat exchanging coils air filter panels indicated at 260 in FIG. 8. These air filter panels can be supported directly by the metal frame members extending about their periphery including horizontal frame members 264 and 266 and the vertical frame members at 75.

A preferred optional feature of this air inlet section is an acoustical resonator 265 mounted at a bottom end of the elongate airflow member 220 and located adjacent the fan unit. The illustrated air inlet section in fact has two of these resonators including a second resonator 266 located directly below the resonator 265. Each resonator can be filled with a light, sound absorbing fibre, if desired, and each has a series of circular holes 268 distributed about its periphery. The number of holes will vary depending upon the sound range that the attenuator is intended to reduce.

The use of acoustical resonators of this type has been previously illustrated and described in U.S. Pat. No. 5,426,268 issued Jun. 20, 1995, the disclosure and drawings of which are incorporated herein by reference. An acoustical resonator of this type is useful in reducing the blade passage frequency noise. The resonator is in the form of an enclosed chamber having the aforementioned holes 268 about its periphery. The chamber is defined by a generally cylindrical side wall 270 and circular end walls at the top and bottom edges of the side wall. The upper airflow passageway 208 extends about the cylindrical side wall 270 of each resonator. The walls of the chamber can, for example be made of sixteen gauge sheet metal. It is also possible for the acoustical chamber to be empty rather than filled with light fibre.

Figure 10:
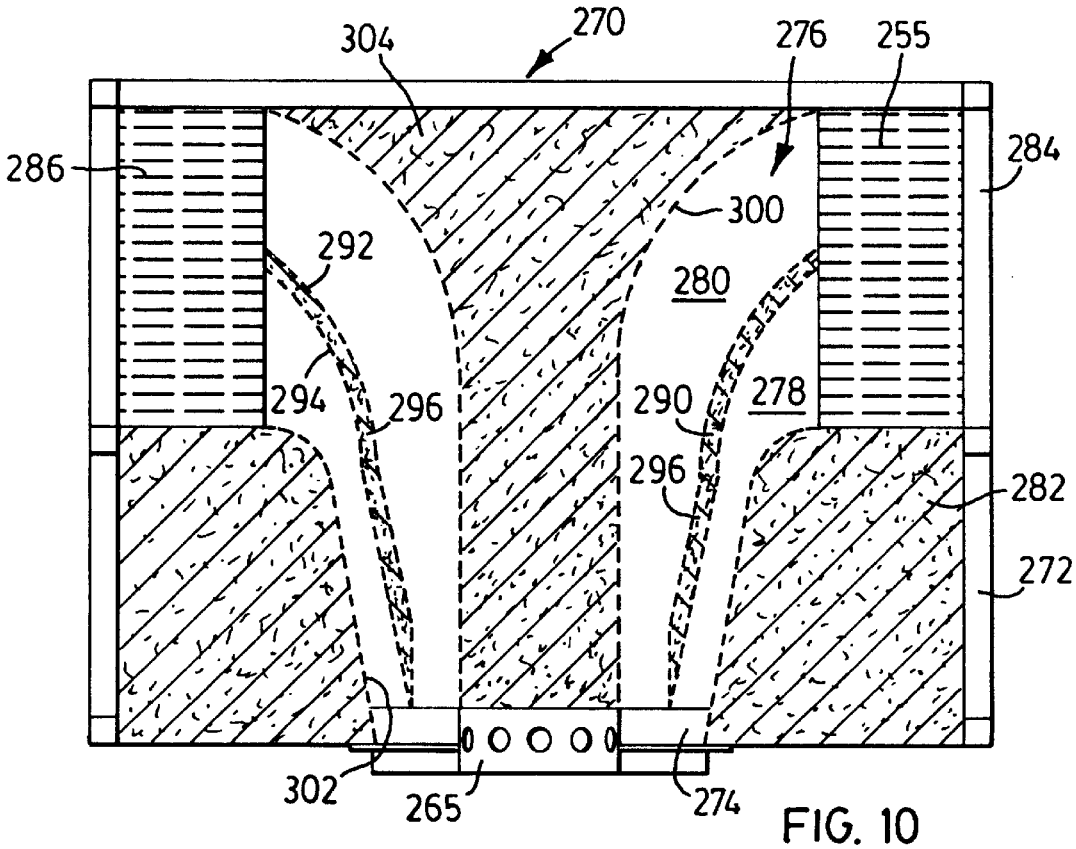
FIG. 10 is a vertical cross-section taken along the central axis of a further embodiment of the inlet attenuator.
Figure 11:
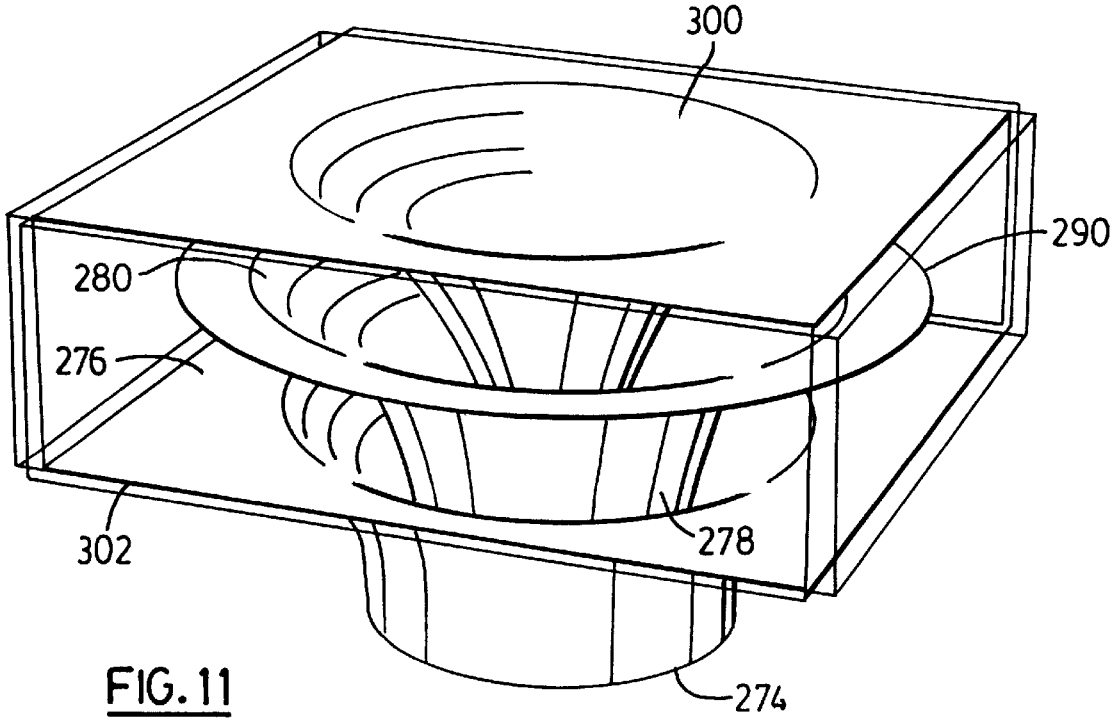
FIG. 11 is a three-dimensional schematic illustration of the three conical wall members used in the embodiment of FIG. 10.

Turning now to a further embodiment of the air inlet and sound attenuator section that can be used in the invention, this further embodiment is illustrated in FIGS. 10 and 11 of the drawings. This further air inlet and sound attenuator section is indicated generally at 270 and again this embodiment is similar to the previously described air inlet and sound attenuator sections except for the differences herein described. This air inlet section 270 again has an inlet housing 272 with a round bottom air outlet 274 that is also annular. The upper airflow passageway that extends between the air inlets and the annular air outlet 274 is indicated generally by 276 and it will be seen that this passageway is divided into an outer airflow passageway 278 and an annular inner airflow passageway 280. The upper airflow passageway 276 is surrounded on vertically extending sides thereof with sound absorbing material 282 which is of course covered on the outside by exterior panels of the housing 272. The upper section of the housing 272 had an air inlet opening in two or more of the vertically extending sides with two of these openings 284, 286 visible in FIG. 10. There can be as many as four of these air inlet openings, one on each of the four vertical sides of the air inlet section, if desired. As in the embodiment of FIG. 7, there can be a heat exchanging coil unit 255 located in one or more of these air inlet openings in order to heat or cool the incoming airflow.

It will be seen that the two smaller airflow passageways 278 and 280 each extend from the air inlet openings to the bottom air outlet 274 and these passageways are separated by a substantially conical divider wall 290 which is substantially coaxial with the upper airflow passageway 276. Although it is possible for this divider wall 290 to be constructed of non-perforated sheet metal and for the wall to be only the thickness of the single sheet metal panel, in a preferred version of this air inlet section the divider wall 290 is made with two, spaced-apart sheet metal walls 292, 294 with each of these sheet metal walls having a substantially conical shape. A relatively narrow space between these perforated metal walls is filled with standard sound absorbing material 296. It is also possible that only one of the two sheet metal walls is perforated while some or all of the other sheet metal wall is non-perforated with the exact configuration depending on various factors such as the amount of sound reduction required, airflow speed, etc. In one possible embodiment, only the outer metal wall 294 is perforated, this wall forming an outer airflow defining surface which faces substantially downwardly and radially outwardly.

In the embodiment of FIGS. 10 and 11, the upper airflow passageway 276 is defined by an upper interior wall 300 and a lower interior wall 302 and both of these walls are made of perforated sheet metal. The lower interior wall 302 covers the aforementioned sound absorbing material 282. As can be seen from both FIGS. 10 and 11, both of these interior walls have a substantially conical shape although each wall has a rectangular top edge that can be seen clearly in FIG. 11. This conical configuration provides for a very smooth incoming airflow that extends from the air inlets 284, 286 to the annular outlet at 274. The conical interior space located within the interior wall 300 is filled with sound absorbing material 304, this material not being shown in FIG. 11 for purposes of illustration. It will be understood that a top wall or panel closes the top of the air inlet section 270 and thus there is no air inlet in the top of this version.

Although only two heat exchanging coil units 255 can be seen in FIG. 10, if in fact this air inlet section 270 has air inlets in all four sides, it will be appreciated that there can be a heat exchanging coil unit mounted in the air inlet of each side so that all of the airflow entering the unit is required to pass through the heat exchanging coil units. If there is no air inlet on one side of a particular air inlet section 270, the boxlike space where there would be a heat exchanging coil unit if the side had an air inlet is preferably filled with sound absorbing material that is covered on the inside surface with perforated sheet metal.

It will also be appreciated by those skilled in the air handling art that the air inlet silencer of FIGS. 10 and 11 can also be used as an outlet silencer in the column fan unit of this invention. In this situation, the air inlet and sound attenuator section 270 would be positioned downstream from the axial fan unit and its annular air outlet at 274 would become an inlet to receive the airflow from the air fan. The outlets for this air outlet attenuator would then be the air outlets at 284, 286. In other words, the attenuator section 270 when used as an air outlet section can be used in place of the air outlet attenuator 24 illustrated, for example, in FIG. 2. It might also be noted that the optional acoustic resonator 265 can also be employed when the silencer unit of FIG. 10 is used as an air outlet silencer.

From the above description, it will be seen that an efficient air handling system has been provided for use particularly in high-rise buildings. The use of the air handling system of the invention can avoid the need for a large mechanical room to hold a relatively large air handling system capable of supplying air to an entire high-rise building. The system of the invention in its preferred form has several additional advantages including the fact that its column like appearance can make it easier to conceal on each floor of the building as it can have the appearance of a structural column of the building. The present system also can provide maximum flexibility with respect to the distribution of the air supply on each floor level of the building and it reduces substantially the need for the ducting of conditioned air to various locations in the building. The use of such a system will also permit the owner of the building to add heating or cooling capability almost at any desired location in the building without affecting other regions of the building and without having to make major modifications to the complete air handling system. In this regard, it should be noted that heating or cooling coils can be mounted in the air mixing chamber to give the unit 10 either a heating or cooling capability (or both). Preferred versions of this air handling system can also be made relatively quiet so as not to disturb persons located in the vicinity of the air handling unit.

It will be readily apparent to those skilled in the air handling art that various modifications and changes can be made to the described air handling system without departing from the spirit and scope of this invention. Accordingly, all such modifications and changes as fall within the scope of the appended claims are intended to be part of the present invention.

What is claimed is:

1. An air handling system for use in a multiple story building in order to supply air to one level of said building, said system comprising:

an outlet attenuator adapted for mounting on a floor of said building and including an exterior outlet housing having an air inlet in a top thereof and a lowermost air outlet in at least one vertical side thereof, said air inlet and air outlet being connected by a lower airflow passageway defined by interior walls of said outlet attenuator, said outlet attenuator further including sound absorbing material which is contained in said housing and extends to and is covered by said interior walls;

a fan unit mounted above said outlet attenuator and capable of providing downward airflow into said air inlet of the outlet attenuator; and a fan inlet section mounted above said fan unit and extending upwardly therefrom, said inlet section including an exterior inlet housing with a bottom air outlet in a bottom end thereof and an upper airflow passageway that extends downwardly to said bottom air outlet, wherein said bottom air outlet is positioned directly above an airflow inlet of said fan unit.

2. An air handling system according to claim 1 wherein said fan unit includes an axial fan having a vertical axis of rotation.

3. An air handling system according to claim 2 wherein said fan inlet section includes a central elongate airflow member mounted centrally in said upper airflow passageway and having a vertical longitudinal axis, and wherein said elongate airflow member contains sound absorbing material.

4. An air handling system according to claim 3 wherein said elongate airflow member includes an outer peripheral wall that is made of perforated sheet metal and that diverges outwardly from an upper end to a bottom end thereof.

5. An air handling system according to claim 3 wherein said air inlet section further includes two or more intermediate airflow members mounted in said upper airflow passageway and spaced from said central elongate airflow member and from internal walls defining an outer periphery of said upper airflow passageway, each of said intermediate airflow members being tapered inwardly in a downwards direction from an upper end section thereof.

6. An air handling system according to claim 5 wherein each of said intermediate airflow members includes inner and outer peripheral walls that are made of perforated sheet metal and sound absorbing material contained between said inner and outer peripheral walls.

7. An air handling system according to claim 1 wherein said fan inlet section is a sound attenuator and contains sound absorbing material positioned behind perforated interior walls of said fan inlet section and said fan inlet section includes at least one heat exchanging coil unit arranged so that incoming airflow passes through said at least one coil unit.

8. An air handling system according to claim 7 wherein said fan inlet section includes a central elongate airflow member mounted centrally in said upper airflow passageway and having a vertical longitudinal axis, and wherein said elongate airflow member contains sound absorbing material.

9. An air handling system according to claim 4 wherein said fan inlet section includes two or more side inlet openings and a top inlet opening, said side inlet openings being adapted to receive return air from an interior region of said one level of the building and said top inlet opening adapted to receive fresh incoming air from a location outside said one level of the building.

10. An air handling system according to claim 3 wherein said lowermost air outlet is provided in at least three vertical sides of said exterior outlet housing and said lower airflow passageway curves through approximately 90 degrees form said air inlet to the lowermost air outlet in each of said at least three vertical sides.

11. An air handling system for use in a building in order to supply an air mixture to said building, said system comprising, in combination:

an air outlet and sound attenuator section adapted for mounting on a floor of said building and including an outlet housing containing sound absorbing material and having a lower airflow passageway extending vertically through said outlet housing to a lowermost air outlet located in at least one vertical side thereof, a fan unit mountable above said air outlet and sound attenuator section and capable of providing downward airflow into said lower airflow passageway; and an air inlet and sound attenuator section mounted above said fan unit and including an inlet housing with a round bottom air outlet in a bottom end thereof and an upper airflow passageway that tapers inwardly in a downwards direction and that extends downwardly to said bottom air outlet, said upper airflow passageway being surrounded on vertically extending sides thereof with sound absorbing material, said inlet housing having at least first and second air inlet openings found in an upper section thereof, said first air inlet opening adapted to receive fresh incoming air and at least said second air inlet opening adapted to receive return air from said building, wherein, during use of said air handling system, said fresh incoming air and said return air are mixed in said air inlet and sound attenuator section and a mixed airflow as delivered by said upper airflow passageway to an inlet of said fan unit.

12. An air handling system according to claim 11 wherein said fan unit is an axial fan unit having a vertical axis of rotation and said inlet housing has perforated interior walls made of sheet metal and forming said vertically extending sides of said upper airflow passageway.

13. An air handling system according to claim 12 wherein said air inlet and sound attenuator section includes at least one heat exchanging coil unit arranged in at least one of said air inlets so that incoming air passes through said coil unit.

14. An air handling system according to claim 12 wherein said air inlet and sound attenuator section includes a central elongate airflow member mounted centrally in said upper airflow passageway and having a vertical longitudinal axis, and wherein said elongate airflow member contains sound absorbing material.

15. An air handling system according to claim 14 wherein said elongate airflow member includes an outer peripheral wall that is made of perforated sheet metal and that diverges outwardly from an upper end to a bottom end thereof.

16. An air handling system according to claim 14 wherein said air inlet and sound attenuator section further includes two or more intermediate airflow members rigidly mounted in said upper airflow passageway and spaced from said central elongate airflow member and from said vertically extending sides of the upper airflow passageway, each of said intermediate airflow members being tapered inwardly in a downwards direction from an upper end section thereof.

17. An air handling system according to claim 16 wherein said lowermost air outlet is provided in at least three vertical sides of said outlet housing and said lower airflow passageway curves through approximately 90 degrees from an air inlet at a top of said outlet housing to said lowermost air outlet in each of said at least three vertical sides.

18. An air handling system according to claim 14 including an acoustical resonator mounted at a bottom end of said elongate airflow member and located adjacent said fan unit.

19. An air handling system for use in a building in order to supply treated air to said building, said system comprising:

an air outlet and sound attenuator section adapted for mounting on a floor of said building and including an outlet housing containing sound absorbing material and having a lower airflow passageway extending vertically through said outlet housing to a lowermost air outlet located in at least one vertical side thereof, a fan unit mountable above said air outlet and sound attenuator section and capable of providing downward airflow into said lower airflow passageway, and an air inlet and sound attenuator section mounted above said fan unit and including an inlet housing with a round bottom air outlet in a bottom end thereof and an upper airflow passageway that tapers inwardly in a downwards direction and that extends downwardly to said bottom air outlet, said upper airflow passage being surrounded on vertically extending sides thereof with sound absorbing material, an upper section of said inlet housing having an air inlet opening provided in two or more of said vertically extending sides, said upper airflow passageway being divided into at least two smaller passageways, that extend from said air inlet opening to said bottom air outlet, by means of a substantially conical divider wall which is substantially coaxial with said upper airflow passageway; and at least one heat exchanging coil unit mounted in said air inlet and sound attenuator section for heating or cooling at least a portion of the airflow entering said system through said air inlet opening.

20. An air handling system according to claim 19 wherein said upper airflow passageway is defined by upper and lower interior walls which are made of perforated sheet metal and each of which has a substantially conical shape and is substantially coaxial with said divider wall.

21. An air handling system according to claim 20 wherein sound absorbing material fills a conical space formed by said upper interior wall and said fan unit includes an axial fan with a vertical axis of rotation.

22. An air handling system according to claim 21 wherein said divider wall is made of non-perforated sheet metal and has a circular bottom end at said bottom air outlet.

23. An air handling system according to claim 19 wherein said divider wall is made with two, spaced-apart sheet metal walls, each having a substantially conical shape and sound absorbing material filling a space between said two sheet metal walls.

24. An air handling system according to claim 23 wherein one of said two sheet metal walls is perforated and has an outer airflow defining surface, which faces substantially downwardly and radially outwardly.

25. An air handling system according to claim 19 wherein there are two or more heat exchanging coil units covering all sides of said air inlet opening so that all of the airflow entering said system is required to pass through the heat exchanging coil units.

26. An air handling system for use in a building in order to supply an air mixture to said building, said system comprising, in combination:

an air outlet and sound attenuating section adapted for mounting on a floor of a building and including an outlet housing forming a lower airflow passageway that extends downwardly through the outlet housing to a lowermost air outlet located in at least one vertical side thereof;

an axial fan unit mountable above said air outlet and sound attenuating section and capable of providing downward airflow into said lower airflow passageway; and an air inlet member extending upwardly from said fan unit, having a bottom air outlet in a bottom end thereof, and forming an upper airflow passageway that tapers inwardly in a downwards direction and that extends downwardly to said bottom air outlet; and an inlet housing extending above said air inlet member and forming an air mixing chamber therein for mixing primary air and return air, said inlet housing having one or more air inlet openings formed therein for passage of one or more airflows into said air mixing chamber.

27. An air handling system according to claim 26 wherein said one or more inlet openings include an air inlet openings for primary air arranged in top of said inlet housing.

28. An air handling system according to claim 26 wherein said air outlet and sound attenuating section includes a central airflow defining member having a cylindrical section that extends downwardly from a top of the air outlet and sound attenuating section, said cylindrical section containing sound attenuating material.

29. An air handling system according to claim 26 including air filter panels for filtering incoming airflow prior to passage of said incoming airflow through airflow passageway.

30. An air handling system according to claim 26 including a central airflow defining member mounted within said air inlet member and coaxial therewith, wherein said central airflow defining member contains sound insulating material and assists in sound attenuation.

31. An air handling system according to claim 30 wherein said air inlet member is surrounded with sound attenuating material.

32. An air handling system according to claim 27 wherein said air inlet opening for primary air is arranged centrally in said top of the inlet housing and said air inlet and sound attenuating section includes a central airflow defining member having a cylindrical section that extends downwardly from a top of the air outlet and sound attenuating section, said cylindrical section containing sound attenuating material.

33. An air handling system according to claim 32 including air filter panels for filtering incoming airflow prior to passageway of said incoming airflow through said upper airflow passageway.

34. An air handling system according to claim 33 including a central airflow defining member mounted within said air inlet member and coaxial therewith, wherein said central airflow defining member contains sound insulating material and assists in sound attenuation.

35. An air handling system according to claim 26 wherein said air outlet and sound attenuating section includes a centrally located airflow defining member having an outwardly and downwardly extending outer surface capable of deflecting downward air flow outwardly to said lowermost air outlet.

36. A column fan apparatus for use in a building having a raised floor mounted above a main supporting floor, said apparatus comprising:

an air outlet and sound attenuating section adapted for mounting on said main supporting floor and including an outlet housing forming a lower airflow passageway that extends downwardly through the outlet housing to lowermost air outlets located in two or more vertical sides thereof;

a fan unit mountable above said air outlet and sound attenuating section and capable of providing a downward airflow into said lower airflow passageway; and an air inlet member extending upwardly from said fan unit, having a bottom air flow outlet in a bottom end thereof, and forming an upper airflow passageway that extends downwardly to said bottom air outlet; and an inlet housing surround said air inlet member, extending above said air inlet member, and forming an air mixing chamber for primary air and return air, said inlet housing having a first air inlet opening for primary air and a second air opening for passage of said return air into said inlet housing.

37. A column fan apparatus according to claim 36 wherein said air outlet and said attenuating section includes a central airflow defining member having a cylindrical section that extends downwardly from a top of the air outlet and sound attenuating section, said cylindrical section containing sound attenuating material.

38. A column fan apparatus according to claim 37 including air filter panels for filtering incoming airflow prior to passage of said incoming airflow through said upper airflow passageway.

39. A column fan apparatus according to claim 37 including a central airflow defining member mounted within said inlet member and coaxial therewith, wherein said central airflow defining member contains sound insulating material and assists in sound attenuation.

40. A column fan apparatus according to claim 36 wherein said outlet housing includes a downwardly and outwardly extending interior wall that defines said lower airflow passageway and that is made of perforated sheet metal and wherein sound attenuating material is positioned around an exterior surface of said interior wall.

41. A column fan apparatus according to claim 40 wherein said inlet housing includes an contains sound attenuating material to reduce sound levels during operations of said fan unit.

* * * * *